United States Patent [19]

Zacharin

[11] 3,964,391

[45] June 22, 1976

[54] DISPENSER-LAUNCHED MUNITION WITH TWO-STAGE SPIN-IMPARTING VANES

[75] Inventor: Alexey T. Zacharin, Parsippany, N.J.

[73] Assignee: The United States of America as represented by the Secretary of the Army, Washington, D.C.

[22] Filed: Sept. 4, 1973

[21] Appl. No.: 394,223

[52] U.S. Cl. ..... 102/4; 102/7.2; 244/3.25; 244/3.27

[51] Int. Cl.[2] ..... F42B 13/32

[58] Field of Search ..... 102/4, 7.2, 35.4; 244/3.27, 3.28, 3.29, 38 R, , 38 A, 3.25

[56] References Cited

UNITED STATES PATENTS

| | | | |
|---|---|---|---|
| 1,964,016 | 6/1934 | Wiley | 102/35.4 |
| 2,918,235 | 12/1959 | Aberg et al. | 102/4 X |
| 3,115,831 | 12/1963 | Suter | 102/4 |
| 3,165,281 | 1/1965 | Gohlke | 244/3.29 X |
| 3,604,352 | 9/1971 | Bench | 102/4 |

*Primary Examiner*—Verlin R. Pendegrass
*Attorney, Agent, or Firm*—Nathan Edelberg; A. Victor Erkkila; Thomas R. Webb

[57] ABSTRACT

A dispenser-launched, spin-armed munition is provided with spin-imparting means made up of a set of helically-oriented primary vanes, having an outer envelope substantially equal to that of the munition body, attached to the body, and a set of helically-oriented, resilient, flexible, extension vanes attached to the primary vanes and extending outwardly therebeyond to increase the effective vane area. The flexible vanes are folded inwardly when the munition is inserted into its launch tube and spring outwardly after launch. The flexible vanes are removably attached to the rigid vanes by rivets in such manner that the flexible vanes are separated from the rigid vanes by the airstream at a predetermined spin rate.

3 Claims, 7 Drawing Figures

DISPENSER-LAUNCHED MUNITION WITH TWO-STAGE SPIN-IMPARTING VANES

BACKGROUND AND BRIEF SUMMARY OF THE INVENTION

Presently a variety of dispenser-launched, spin-armed munitions are available covering all types of tactical requirements, from jungle penetration to impact detonating. However, with present types of spin-imparting vanes it is necessary to eject the munition either at a high velocity or at a very high altitude, to complete the fuze arming. Since target accuracy requires relatively low dispensing altitudes, present munitions of this kind can be used with high speed aircraft only.

An object of the present invention is to provide a dispenser-launched munition having spin-imparting vanes that can be satisfactorily dispensed or launched from low speed aircraft, including helicopters, at altitudes as low as 100 feet.

Another object of the invention is to provide such a munition with a two-stage spin-imparting vane assembly.

In accordance with the invention, a dispenser-launched munition, such as a fuzed explosive bomb or grenade, is provided with a first set of helically-oriented, rigid vanes having an outer envelope diameter substantially equal to that of the munition body to permit insertion of the vanes with the munition body into the launch tube, and a second set of helically-oriented, resilient, flexible vanes attached to, and constituting outward extensions of, the rigid vanes. The outer portions of the flexible vanes are folded inwardly for insertion within the launch tube, and automatically spring outwardly after being launched to greatly increase the total effective vane area exposed to the air stream, and hence, impart a high spin velocity to spin acceleration of the munition.

Preferably, the means for attaching the flexible vanes to the rigid vanes is designed so that the flexible vanes will be ripped off at a desired spin rate, e.g. 10,000 r.p.m., considerably higher than the normal arming region of 2500 to 3500 r.p.m., after which the munition is spun by the rigid vanes only.

DETAILED DESCRIPTION OF A PREFERRED EMBODIMENT

Figure 2:
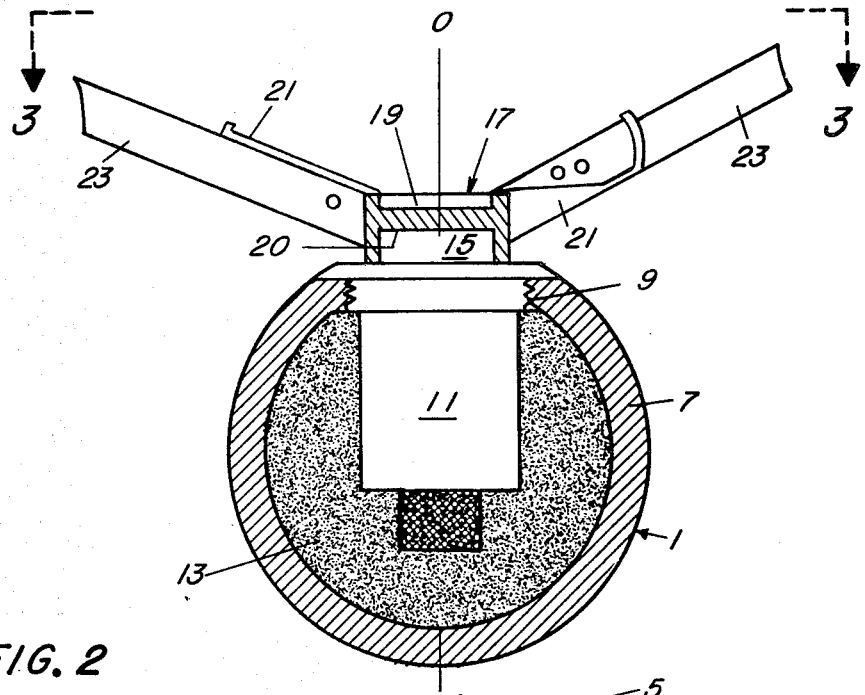
FIG. 2 is an axial section view of one of the munitions of FIG. 1.
Figure 1:
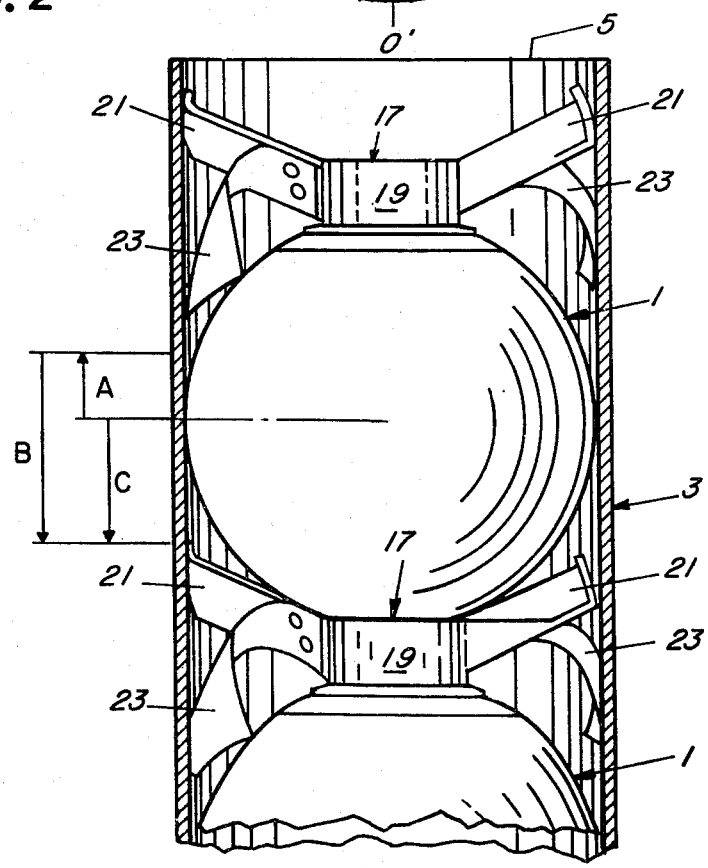
FIG. 1 is an axial section view of a portion of a launch tube containing a plurality of munitions embodying the present invention.

FIG. 1 illustrates the invention embodied, for example, in a BLU-24 bomb 1 slidably disposed, with one or more similar bombs, within a conventional bomb dispenser or launch tube 3, which is open at one end 5. The bomb 1, shown more in detail in FIG. 2, comprises hollow cylindrical body 7, having a diameter slightly less than the diameter of the launch tube 3, and having a threaded aperture 9 in which a conventional spin-armed fuze 11 is mounted. As is well known in the art, a spin-armed fuze is a device for initiating the explosive charge of the munition that includes a means for arming the fuze (placing it in a condition ready for firing) that is actuated by the centrifugal force created by spinning the munition about a predetermined spin axis, usually the longitudinal axis. The fuze 11 may be an M218 Fuze, for example. The space within the body 7 around the fuze 11 is filled with an explosive charge mixture 13 adapted to be initiated or exploded by the fuze 11. The explosive charge mixture 13 and its fuze 11 constitute the payload of the munition. The outer end of fuze 11 is provided with a fixed cylindrical plug 15 to which a spin-imparting vane assembly 17 of the present invention is attached.

Figure 3:
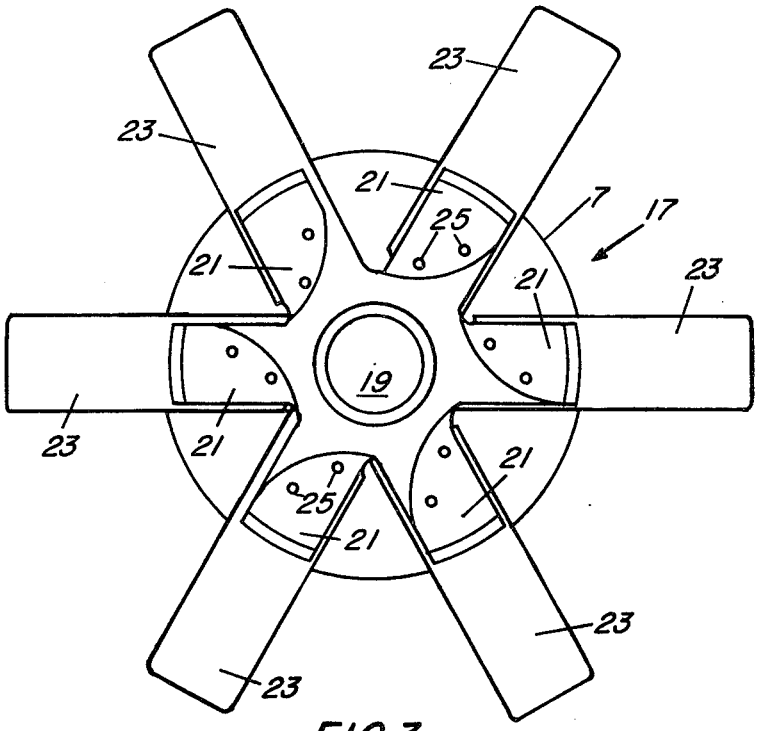
FIG. 3 is an end view of the munition taken in the direction 3—3 of FIG. 2.
Figure 4:
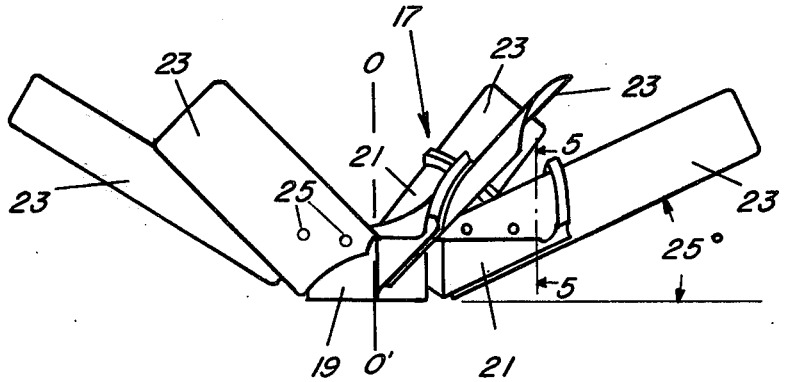
FIG. 4 is a side elevation view of vane structure of the munition.
Figure 5:
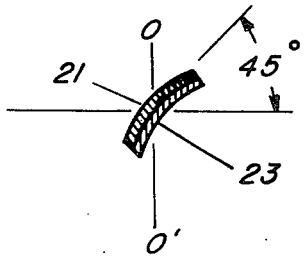
FIG. 5 is a section view of one of the vanes of the munition taken on line 5—5 of FIG. 4.

The vane assembly 17, shown in detail in FIGS. 3–5, includes a hub member 19 having a cylindrical recess 20 fitted over and rigidly attached to the fuze plug 15. Extending outwardly from the hub member 19 are six, substantially-rigid, primary vanes 21, which are preferably integral with the hub 19. The hub 19 and vanes 21 are preferably made of molded plastic, but could be made of metal. Each of the vanes 21 is canted at an acute angle, preferably 45°, with respect to the longitudinal or spin axis 0–0′, and also curved slightly, as shown in FIG. 5, so that the air stream will react with the vanes to impart spin to the bomb 1 in flight. The outer ends of the vanes 21 lie on a circle having a diameter substantially the same as that of the bomb body 7, to fit within the launch tube 3.

The vane assembly 17 also includes six, resilient, flexible, supplemental vanes 23, e.g., of spring steel, each of which is attached at its inner end to the side of one of the rigid vanes 21, as by two rivets 25. As shown best in FIGS. 2 and 4, the flexible vanes 23 constitute outward extensions of the rigid vanes 21. Vanes 23 are curved to fit vanes 21. The addition of vanes 23 greatly increases the effective vane area exposed to the airstream in flight and hence, the vanes 21 and 23 impart to the bomb 1 a spin velocity substantially higher than that which would be produced by the primary vanes alone. Preferably, the vanes 21 and 23 are inclined rearwardly, with respect to a transverse plane perpendicular to the spin axis, e.g. at about 25°, as shown in FIG. 4, for greater stability in flight.

The launch tube 3 may be mounted on an aerial vehicle in a horizontal position with the open end 5 facing rearwardly, with respect to the motion of the aircraft. One or more of the bombs 1 are inserted into the open end 5 of the launch tube 3, either end first. As shown in FIG. 1, where the body 7 is inserted first, it is necessary to fold the flexible vanes 23 back about their concave sides by hand before insertion into tube 3. When the vane assembly 17 is inserted first, the rigid vanes 21 enter the tube 3 and the flexible vanes 23 are folded back by engagement with the open end 3. With both arrangements, the bomb 1 is ejected by suitable means (not shown) rearwardly with respect to the aircraft. However, since the ejection speed A is usually less than the forward aircraft speed B, the bomb has a net forward speed of B−A=C, as shown in FIG. 1, and hence, the bomb will fall, due to gravity along a parabolic path, forwardly and downwardly. With the arrangement shown in FIG. 1, the bomb 1 enters the airstream head-first, with the body 7 forward. The vane assembly 17 not only causes the bomb to spin on its axis, but also stabilizes the axial orientation of the bomb along its parabolic path. When the bomb is inserted into the launch tube vane assembly first, it is launched backwardly but quickly reverses its orientation in the airstream and continues along most its path body-first.

Figure 6:
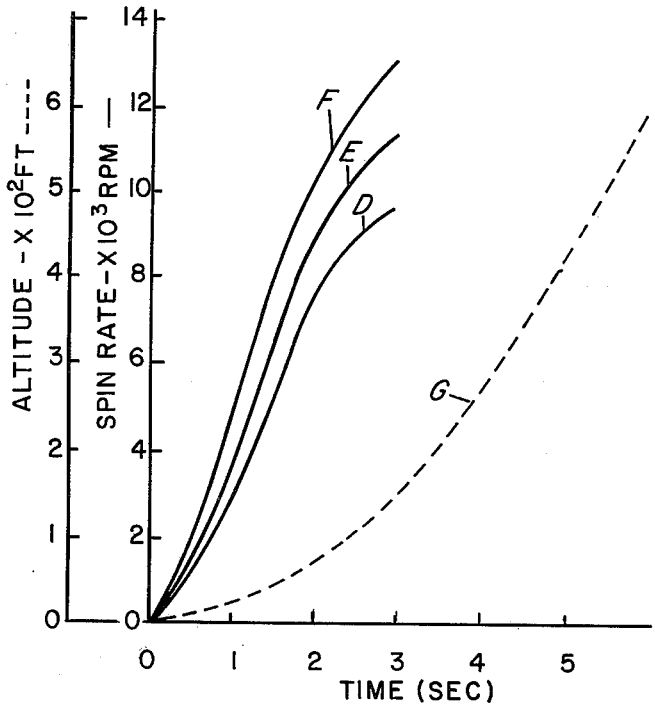
FIGS. 6 and 7 are graphs relating to the operation of the invention.

FIG. 6 presents a set of curves, D, E and F, showing the relationship between spin rate in revolutions per minute and time in seconds, at air speeds of 80, 90 and 100 mph, respectively, obtained from wind tunnel experiments with a BLU-24 bomb having a two-stage arming vane assembly as shown and described herein, and a reference curve G showing the relationship between altitude and time for a free falling body. It can be seen from curves D though G that at helicopter speeds of 80–100 mph the vane assembly 17 will impart to the bomb a spin rate of 9,000 to 13,000 r.p.m. within the first 100 feet of fall (2.5 seconds), which range is well above the normal arming range of 2500 to 3500 r.p.m. of the fuze 11.

Preferably, the rivets 25 are designed to permit the flexible vanes 23 to be ripped off the rigid vanes 21 by the airstream at spin rates of about 10,000 r.p.m. after which only the remaining rigid blades continue to impart spin to the bomb, to avoid excessive spin rates.

Figure 7:
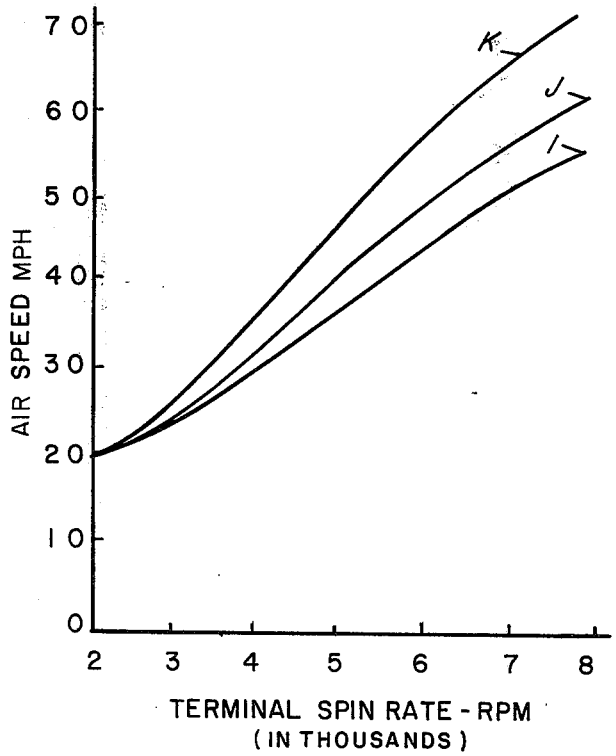

Curves D, E and F of FIG. 6 were obtained with a vane assembly 17 having a pitch angle of 25°. FIG. 7 presents three curves H, I and J showing the relationship of air speed and terminal spin rate for bombs having vanes with three different pitch angles, 20°, 25° and 28°, respectively. Terminal spin rate is the maximum rotational velocity at a particular air speed. Terminal spin rate is reached within a few seconds in an air stream.

250 bombs were assembled each containing an M55 detonator in the fuze assembly and an inert filled bomb body. All of the bombs were launched from a dispenser mounted in a UH5 type helicopter flying at a speed of 80 mph and 200 feet altitude. Almost all of the bombs were recovered and found to have been spin-armed and detonator-fired on impact.

While the invention has been described in connection with a munition having a fuze adapted to be armed by spinning the munition, it will be understood that the same spin-imparting vane assembly could be used merely for imparting spin for gyroscopically stabilizing the munition during flight.

What is claimed is:

1. A munition, adapted to be launched from a tubular dispenser, comprising a hollow body containing a payload and having a spin axis, and means for reacting to the airstream after launch to impart a high spin velocity to said body during a short flight, said means comprising:

a primary vane structure including a diameter of outwardly-extending rigid primary vanes rigidly attached to said body, said primary vanes being helically oriented to said spin axis and capable of imparting a predetermined spin velocity to said body, the diameter of the outer envelope of said primary vanes being no larger than that of said body;

a like plurality of helically-oriented resilient, flexible, secondary vanes each rigidly attached at its inner end to one of said primary vanes and normally extending outwardly a substantial distance therebeyond, to substantially increase the total effective vane area and thereby impart to said body a spin velocity substantially higher than said predetermined spin velocity; said secondary vanes being adapted to be folded inwardly toward said body to permit insertion with said body and said primary vanes into a launch tube and to spring outwardly after launch; and means for removably attaching said flexible vanes to said rigid vanes in such manner that said flexible vanes will be separated from said rigid vanes by the airstream at a predetermined spin rate.

2. A munition as in claim 1, wherein said attaching means consists of two rivets for each pair of connected vanes.

3. A munition as in claim 1, wherein said predetermined spin rate is about 10,000 r.p.m.

* * * * *